US008434231B2

(12) United States Patent
Lenze et al.

(10) Patent No.: US 8,434,231 B2
(45) Date of Patent: May 7, 2013

(54) METHOD FOR PRODUCING A METAL COMPONENT FROM A HOT-STAMPED RAW MATERIAL

(75) Inventors: Franz-Josef Lenze, Lennestadt (DE); Sascha Sikora, Lünen (DE); Andreas Ulrichs, Moers (DE); Lothar Patberg, Moers (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 13/297,895

(22) Filed: Nov. 16, 2011

(65) Prior Publication Data

US 2012/0074733 A1 Mar. 29, 2012

Related U.S. Application Data

(63) Continuation of application No. PCT/EP2010/056677, filed on May 14, 2010.

(30) Foreign Application Priority Data

May 18, 2009 (DE) ..... 10 2009 025 821

(51) Int. Cl.
*B21D 53/88* (2006.01)

(52) U.S. Cl.
USPC ..... 29/897.2; 29/897; 29/897.3; 29/897.312; 29/897.32; 29/897.33

(58) Field of Classification Search ..... 29/897, 29/897.2–897.35; 101/6, 365; 156/209, 156/210; 428/154
See application file for complete search history.

(56) References Cited

U.S. PATENT DOCUMENTS

| | | | | |
|---|---|---|---|---|
| 3,325,302 | A | 6/1967 | Hosfeld | |
| 4,461,665 | A | 7/1984 | Schertler | |
| 4,498,390 | A * | 2/1985 | Bowling et al. | 101/365 |
| 6,306,482 | B1 * | 10/2001 | Ruppel et al. | 428/154 |

FOREIGN PATENT DOCUMENTS

| | | | |
|---|---|---|---|
| DE | 102005038488 | A1 | 2/2007 |
| DE | 102005051403 | B3 | 3/2007 |
| DE | 202006018987 | U1 | 4/2007 |
| DE | 102007030388 | A1 | 2/2008 |
| EP | 1435411 | A1 | 7/2004 |
| WO | WO 97/30817 | A1 | 8/1997 |

* cited by examiner

*Primary Examiner* — Richard Chang
(74) *Attorney, Agent, or Firm* — Reinhart Boerner Van Deuren P.C.

(57) ABSTRACT

The invention relates to a method for producing a metal component, wherein a raw material (4, 34, 42, 74) is provided, the raw material (4, 34, 42, 74) is stamped and is further processed following the stamping process to form a component (90, 108, 114). The component (90, 108, 114) has at least partially stamped areas (16, 36, 48, 98), and the raw material (4, 34, 42, 74) is hot-stamped. The invention further relates to the use of a hot-stamped metal component, which is preferably produced using a method according to the invention, in a motor vehicle body, in particular as a reinforcing element in a B-column (114), a sill, or a longitudinal beam.

16 Claims, 8 Drawing Sheets

METHOD FOR PRODUCING A METAL COMPONENT FROM A HOT-STAMPED RAW MATERIAL

CROSS-REFERENCE TO RELATED PATENT APPLICATIONS

This patent application is a continuation of PCT/EP2010/056677, filed May 14, 2010, which claims priority to German Application No. 10 2009 025 821.3, filed May 18, 2009, the entire teachings and disclosure of which are incorporated herein by reference thereto.

FIELD OF THE INVENTION

The present invention relates to a method for producing a metal component, in which a starting material is provided, the starting material is embossed and after the embossing is processed further to form a component, wherein the component comprises at least partially embossed regions. The invention also relates to an advantageous use of a metal component produced in this way. A starting material within the scope of the invention is understood to be a blank, a semi-finished product or a strip of metal.

BACKGROUND OF THE INVENTION

In the production of metal components, in particular car body components, the production process has to satisfy various requirements. For example, in the production of car body components it is particularly important to satisfy the required strength properties with as low a component weight as possible, and also minimise the production costs. In order to meet these requirements various strategies are adopted in production processes for metal components and car body components of the prior art.

One possibility of reducing the component weight while retaining the same strength is to use variable wall thicknesses within a component. For example, in DE 10 2007 030 388 A1 a method and a device are disclosed for producing a hardened sheet metal component, in which flexibly rolled materials, so-called "Tailored Rolled Blanks", are used. Alternatively blanks of different wall thicknesses welded to one another, so-called "Tailored Welded Blanks", can also be used to produce metal components. A further possibility of optimising the weight of car body components from the prior art is to use embossed metal sheets. In this method a blank in the cold state is cold rolled between two rollers. At least one of the rollers has on its surface the structure required for the embossing. The employed material can be fed as a coil or, cut to length, as an individual blank to the roller. After the embossing the material is normally packaged and transported to the processing site. In order to provide crash-optimised components, inter alia the structure of the cold-rolled embossed blanks must be altered at the processing site. This is carried out for example by localised application of heat. The disadvantage of these methods from the prior art is that the production costs of crash-optimised components are raised. Furthermore, on account of the cold embossing rolling there is an increased wear of the rollers because of high rolling forces.

The technical object of the invention is accordingly to provide a method in which the production costs for crash-optimised components are reduced and at the same time there is reduced wear of the rollers.

SUMMARY OF THE INVENTION

This is achieved according to the invention in a generic method in which the starting material is hot embossed.

It had become known that in the hot embossing of the starting material significantly reduced forces are necessary to produce the embossings. In hot embossing the blank is previously heated to a temperature of above $AC_1$, i.e. to more than 723° C., and is then embossed. In this way an at least partial structure transformation of the blank to an austenitic structure takes place before the embossing. An austenitic structure requires lower forming forces. The pressing force of the press or embossing roller is consequently less, so that the press or roller and the associated drive simply have to be designed for smaller forces and are subject to less wear. This leads to a cost reduction of the method compared to the embossing method of the prior art.

In a preferred embodiment of the method the starting material is hot embossed with a roller. The use of a roller for the hot embossing has the advantage that the embossing can be carried out continuously and this step of the production process can consequently be integrated better into a process sequence.

It has been found that particularly small forces are sufficient for good embossing results if the starting material is hot embossed above $AC_3$. In this case a completely austenitic structure is present, so that in the hot embossing a complete structure transformation to martensite can take place. This results in particularly high strengths of the blanks after the hot embossing.

In a further preferred embodiment of the method according to the invention the starting material at least partially fully hardens in the embossed region. Due to the contact between the roller and the starting material in the region of the embossing, there is a cooling of the hot metal if the temperature difference between the roller or embossing punch and the starting material is sufficiently large. In this way a structure change can be achieved, resulting in a hardening process in particular in the base of the embossings. Thus, it is possible to produce in a simple manner metal components with local hardness differences that have for example a crash-optimised strength profile.

In a further preferred embodiment of the method the cooling can be specifically optimised in a targeted manner by actively cooling the embossing tool, in other words the embossing roller or the embossing punch, during the rolling. In this way in particular the cooling rate and thus the degree of hardening can be adjusted.

A further preferred embodiment of the method according to the invention is provided if the starting material consists of a steel alloy, in particular a manganese-boron steel. The requirements demanded of car body components in the automotive industry can be particularly well met with these materials. Furthermore, manganese-boron steel especially has a particularly high strength.

The properties of the metal component, for example the corrosion resistance, can in a further preferred embodiment be specifically adjusted if the starting material is coated metallically or organically/inorganically.

A further reduction of the production costs is achieved in yet a further embodiment if the starting material after the embossing is tempered to the processing temperature for the subsequent further processing. The thermal energy that was required for the tempering of the metal component for the heat embossing process can thus be at least partly used for the subsequent further processing. Accordingly, for the further processing the metal component does not have to be heated from for example room temperature to the processing temperature, but simply from the temperature after the embossing to the processing temperature. This leads to a significant energy saving.

A further preferred embodiment of the method according to the invention is provided if the starting material is hot formed and/or press hardened after the embossing. The processing temperatures required for the hot forming or press hardening are in a similar range as the preferred embossing temperature. Accordingly, after the embossing particularly little energy is necessary in order to bring the embossed semi-finished product to the desired processing temperature. Furthermore high degrees of forming can be achieved by hot forming and the component can be formed very flexibly.

Due to the press hardening of the embossed metal component a different hardness distribution in the metal component can be achieved if the non-embossed regions have direct contact with the surface of the press hardening tool and thus cool more rapidly than the embossed regions. In this way on the one hand the non-embossed regions can have a higher hardness than the embossed regions, while on the other hand in combination with the partial hardening of the embossed regions during the embossing process, a different or identical full hardening can be achieved in the embossed and in the non-embossed region.

In a further preferred embodiment of the method according to the invention the starting material is embossed with a microstructure. In this way particularly homogeneous properties, in particular strength and hardness properties of the metal component, can be achieved. Also the embossings provided with a microstructure can provide a good combination of high strength and large weight reduction. The microstructure can have any conceivable and in practice achievable shape or configuration. For example it is possible to emboss a microstructure with a roughness depth Ra of 50 μm to 500 μm.

A very flexible composite component is obtained in a further embodiment if a blank is used as starting material and after the embossing the blank is joined over its surface area to a further blank, preferably joined on the embossed side. These blanks are then preferably joined to one another by a cladding rolling and/or by combined hot rolling. In cladding rolling the blanks can be cohesively joined to one another without forming a positive engagement. In combined hot forming a positive engagement is produced, which joins both blanks to form a component. Optionally air gaps can be provided between the embossed blanks, which improves the expansion capability of the component. A joining can however also be effected by other known methods, for example by soldering. Particularly flexible properties are achieved in the production of the aforedescribed component if both blanks consist of different materials.

In a further embodiment of the method according to the invention the starting material is embossed specifically in the regions that contribute to the weight reduction. In this way it is possible to produce components that have roughly the same strength but weigh less.

In a further preferred embodiment of the method the starting material is embossed specifically in a stress-targeted manner, in particular with regard to the crash behaviour. On account of the material thinning that is achieved in the embossing and/or due to the hardness distribution in the component achieved during the embossing or due to the subsequent process steps, it is possible to adjust locally the hardness and/or strength properties of the component depending on the respective stress to be expected, in particular in the event of a crash.

The technical object is achieved in a second teaching if a hot-embossed metal component, preferably produced by the production process according to the invention, is used in a vehicle body, especially as a reinforcing element in a B column, a rocker panel or a longitudinal member. Due to the hot embossing the characteristic properties of crash-optimised components can be specifically adjusted in a simple way.

BRIEF DESCRIPTION OF THE DRAWINGS

Further features and advantages of the invention can be derived from the following description of exemplary embodiments. In this connection reference is made to the accompanying drawings, in which.

DETAILED DESCRIPTION OF THE INVENTION

Figure 1:
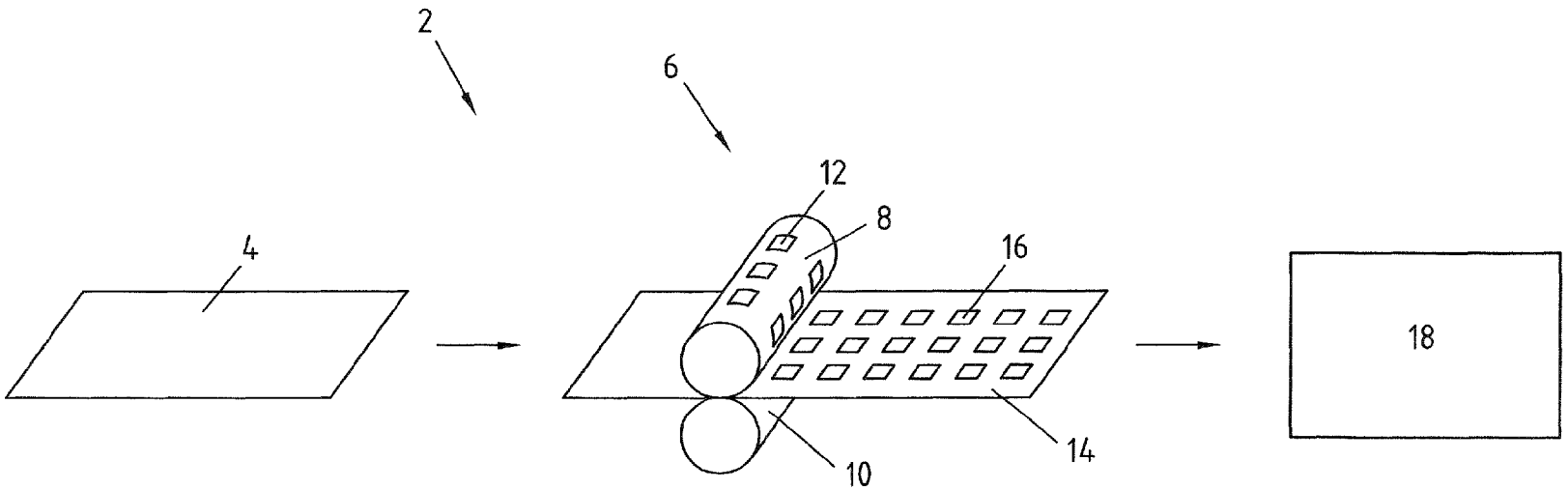
FIG. 1 shows a first exemplary embodiment of the method according to the invention.

A first exemplary embodiment of the method according to the invention is shown in FIG. 1. In the method 2 a blank 4 is first of all provided as starting material. Instead of a blank a semi-finished product, for example a "tailored blank" or a strip, could be used here and in the other exemplary embodiments.

The blank 4 is tempered for the hot embossing and therefore preferably has a temperature above the $AC_3$ temperature. The blank 4 in the present exemplary embodiment consists of a manganese-boron steel and is heated to a temperature of 900° to 950° C. After the heating the blank 4 is hot embossed in a rolling stand 6. The rolling stand includes an upper roller 8 and a lower roller 10, the upper roller 8 having a structured surface for the embossing. This is schematically illustrated in FIG. 1 by raised portions 12. After the hot embossing the embossed blank 14 has embossings 16 introduced by the raised portions 12.

The rolling stand 6 is simply illustrated diagrammatically, i.e. in particular it is not restricted to two rollers. It can also be designed as a four-roller or six-roller arrangement. The embossings 16 can be incorporated into the blank 14 also by a plurality of embossing rollers or by an embossing punch. The embossings 16 can also be incorporated on both sides of the blank 14, for example when also the lower roller 10 has raised portions. After the hot embossing procedure the embossed blank 14 or the embossed semi-finished product are processed further in a further work step 18 to form a component. This further work step 18 can include in particular forming procedures, press hardening procedures, but also machining and joining procedures.

Figure 2:
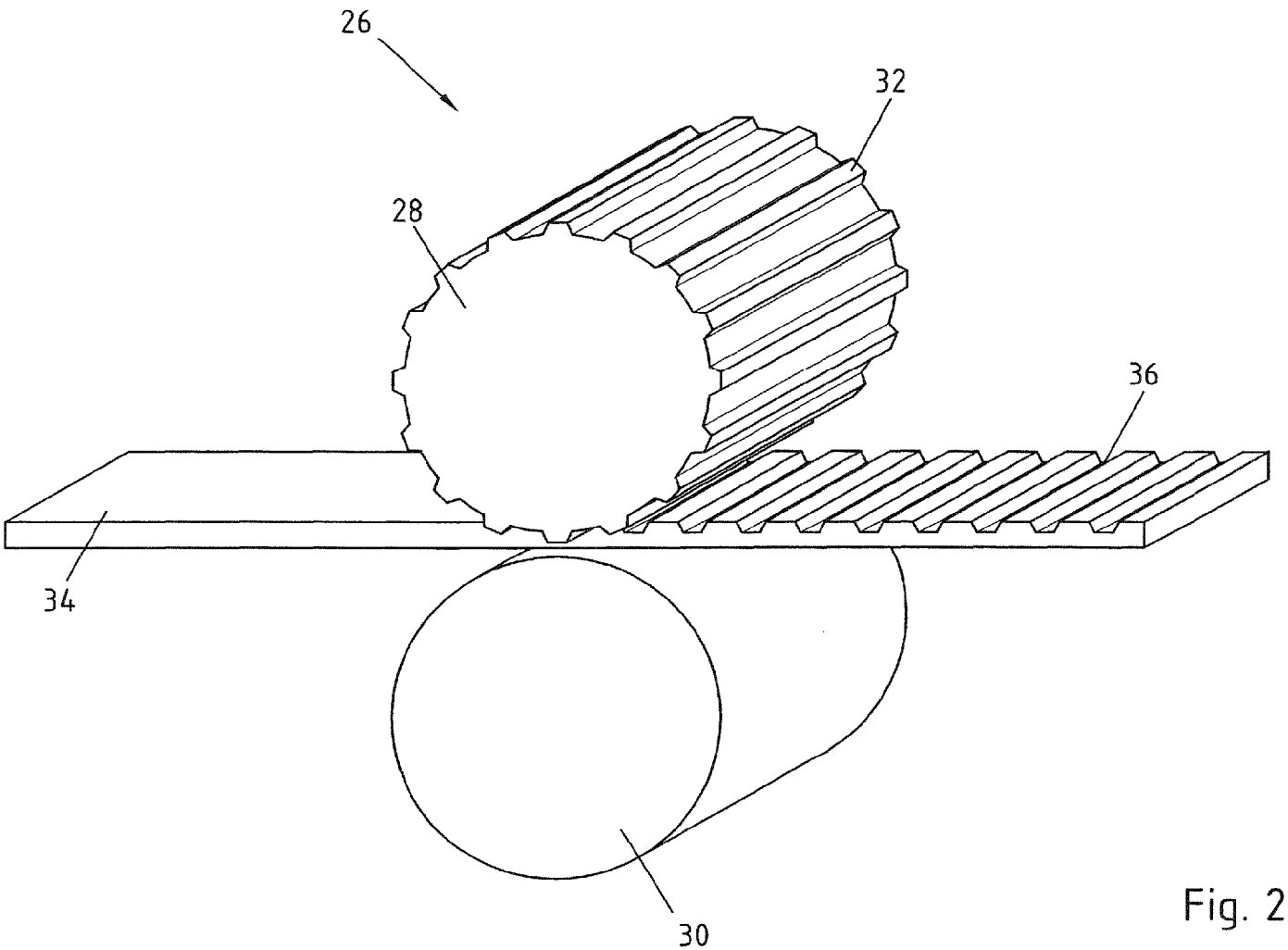
FIG. 2 shows a second exemplary embodiment of the method according to the invention.

A further exemplary embodiment of a rolling stand 26 for the hot embossing of the starting material is illustrated in FIG. 2. The rolling stand 26 has an upper roller 28 and a lower roller 30. Parallel raised portions 32 are arranged on the surface of the upper roller 28, with which the blank 34 is embossed during the hot rolling. The embossed blank 34 thus has strip-shaped raised embossings 36 after the hot rolling procedure. The method is in principle not limited however by the shape of the embossings.

Figure 3:
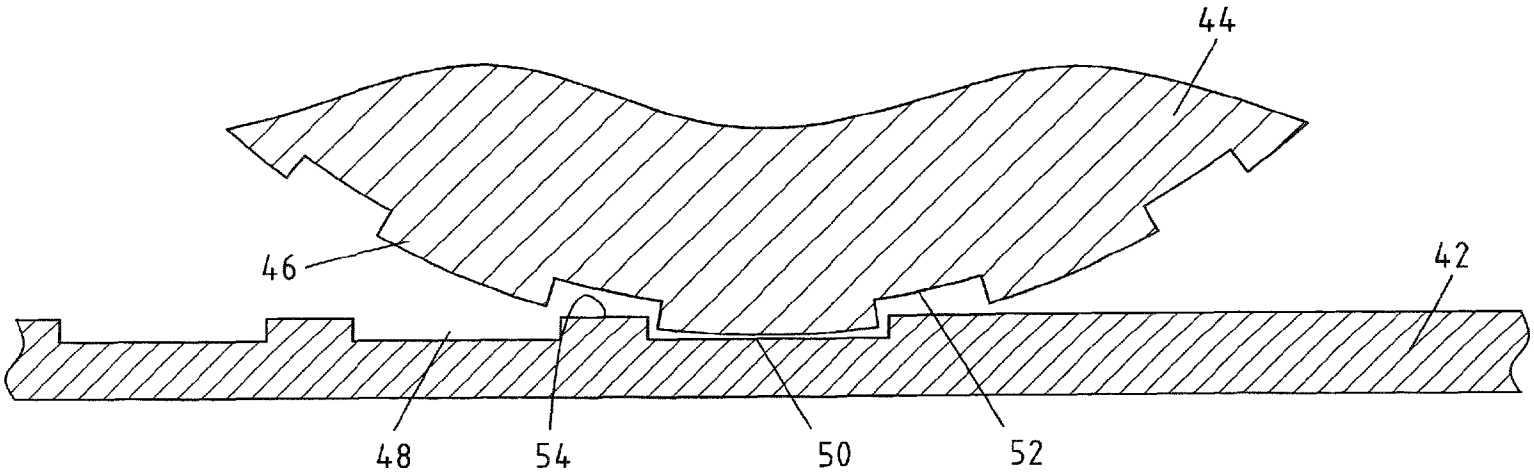
FIG. 3 shows a third exemplary embodiment of the method according to the invention.

FIG. 3 is a sectional view of such a hot embossing procedure. The blank 42 is embossed by the upper roller 44, which is shown only partly in FIG. 3, by means of the raised portions 46 present on the surface. The lower roller is not shown for reasons of clarity. In the embossing procedure a raised portion 46 of the roller 44 in each case makes an embossing 48 in the blank 42. Before the embossing the blank 42 can have a temperature above the $AC_3$ temperature and can be cooled by contact with the profiled sections 46 in the base 50 of the embossing 48. In this way a partial hardening or complete hardening of the blank in the region of the embossing base 50 can be achieved.

This effect can be intensified if the upper roller 44 is actively cooled. For this, the roller 44 may for example comprise a liquid cooling system in its interior. The depth of the embossings 48 is dimensioned in FIG. 3 so that the intermediate region 52 of the roller 44 between the raised portions 46 is not in direct contact with the blank 42. In this way a marked cooling of the regions 54 of the blank 42 lying between the embossings 48 is avoided, so that the blank in this region substantially undergoes no structural change, in particular no hardening. In this way a different hardness distribution in the embossed and non-embossed regions of the blank 42 can be achieved. A particularly homogeneous structure of the blank 42 can optimally be achieved if the blank 42 is embossed with a microstructure.

Figure 4:
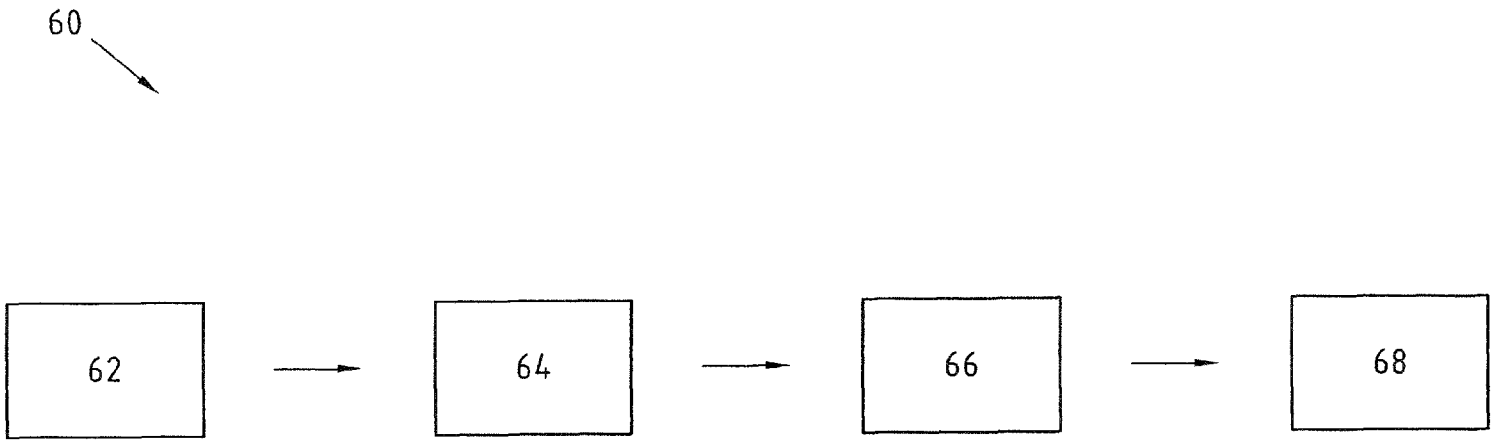
FIG. 4 shows a fourth exemplary embodiment of the method according to the invention.

FIG. 4 shows a flow diagram of a further exemplary embodiment of a method according to the invention. In the method 60 a starting material, i.e. a blank, a semi-finished product or a strip, is provided in a first step 62 and is tempered to the temperature for the hot embossing. This temperature is preferably above the $AC_3$ temperature of the starting material. In the next step 64 the starting material is then hot embossed, in particular with a roller or a punch. In the embossing procedure part of the starting material can harden, for example in the embossed region due to contact with the roller or with the punch.

After the embossing procedure the starting material as a rule has a temperature that is far above room temperature. In the following step 66 the embossed starting material is tempered for the further processing planned in the following step 68. In this connection use is made of the fact that, due to the already elevated temperature of the starting material after the hot embossing, less energy has to be expended in order to bring the starting material to the processing temperature, than in the case of cold-embossed blanks.

In particular the starting material after the embossing can at least in part still have a temperature above the $AC_1$ temperature. For a further processing temperature above the $AC_1$ temperature necessary in the following step 68, only a slight tempering of the starting material is therefore necessary. A processing temperature above the $AC_1$ temperature is required in particular with hot forming and press hardening. Accordingly the starting material is preferably hot formed or press hardened in step 68.

If the embossed starting material is formed as a blank, then this blank can optionally also be joined to a further cold or hot blank, preferably on the embossed side.

Figure 5A:
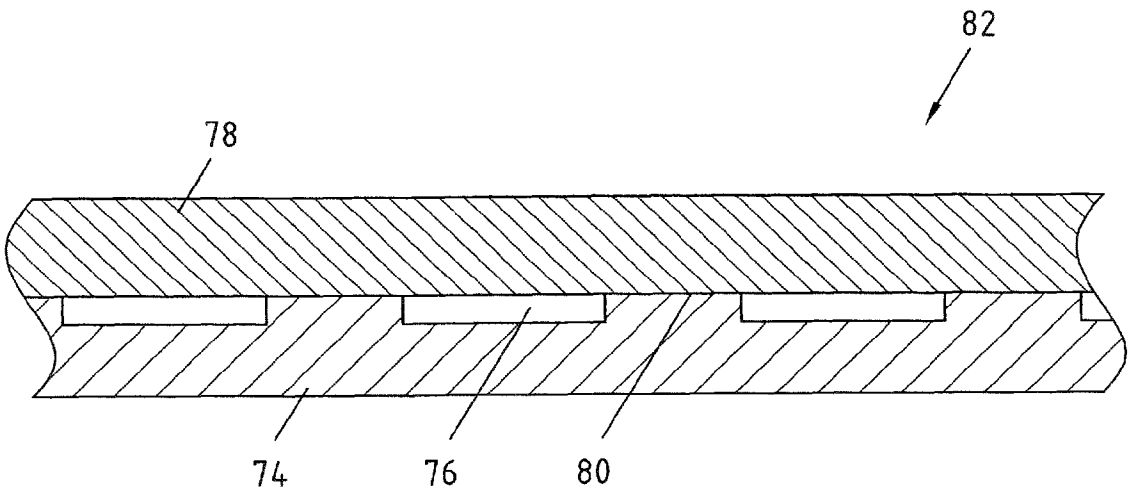
FIG. 5 shows a fifth exemplary embodiment of the method according to the invention.

An embossed blank 74 with embossings 76 on the upper side is illustrated in FIG. 5*a*. To this embossed blank is applied a further blank 78, which contacts the blank 74 in the non-embossed regions 80. If a cold blank 78 is joined to the embossed blank 74, then this can lead, due to the cooling associated therewith, to a hardening of the non-embossed regions 80 of the embossed blank 74. The blanks 74 and 78 may for example be firmly bonded to one another, in particular by welding. In this way a flexible composite component 82 is produced. The air gaps between the blanks 74 and 78 in the region of the embossings 76 can contribute specifically to an improvement of the expansion capability of the component 82.

By choosing different materials for the blanks 74 and 78, in particular different steel alloys with different strength and hardness properties, various components 82 can be fabricated in a very flexible way.

Figure 5B:
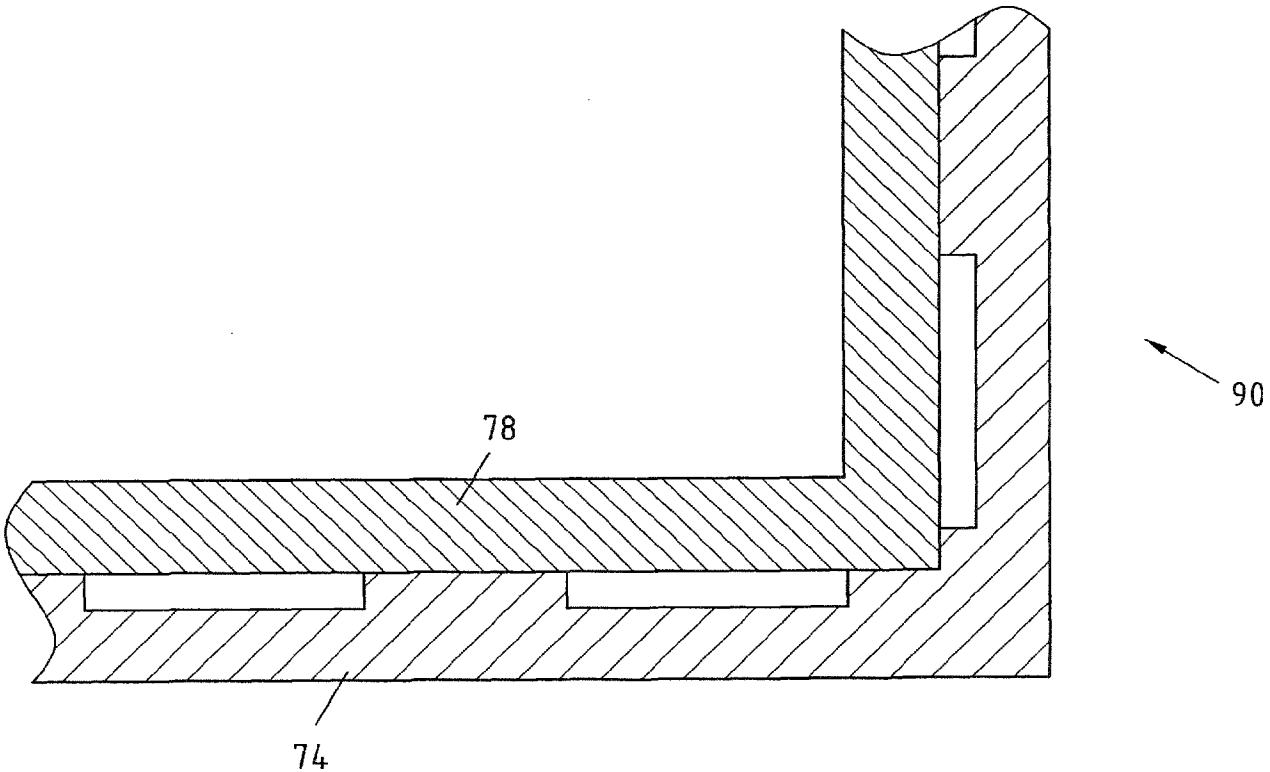

Instead of a firm connection between the blanks 74 and 78 it is also possible for the blanks to be joined to one another by way of a positive engagement by a rolling process or by combined forming. In FIG. 5*b* the embossed blank 74 and the further blank 78 are shown after a joint forming procedure. The two blanks 74 and 78 are joined to one another by positive engagement and/or frictional connection in their common bearing region by the forming procedure. In this way a complexly formed composite component 90 can be produced without an additional welding operation.

Figure 6A:
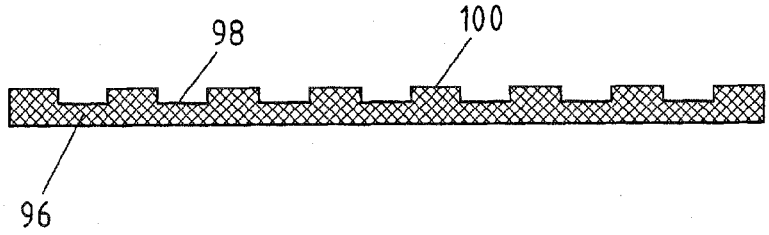
FIG. 6 shows a sixth exemplary embodiment of the method according to the invention.
Figure 6B:
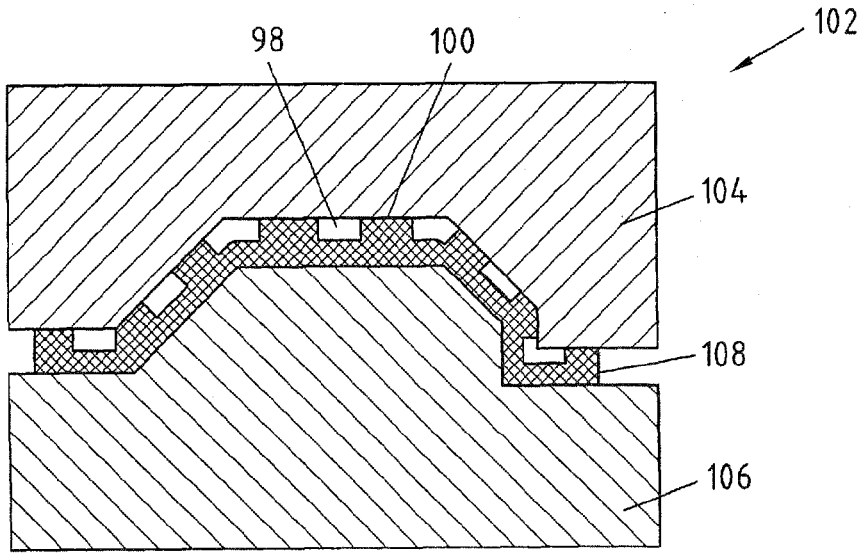
Figure 6C:
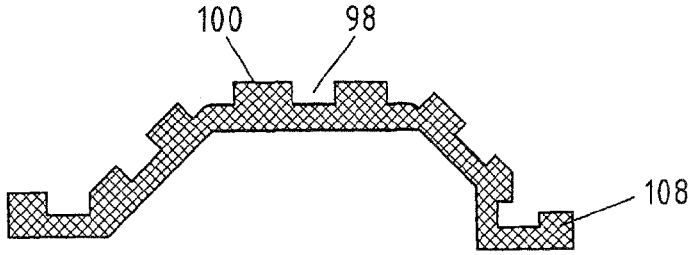

A further exemplary processing step of a hot-embossed starting material in the form of a blank is illustrated in FIGS. 6*a* to 6*c*. The hot-embossed blank 96 comprises embossed regions 98 and non-embossed regions 100. The temperature of the embossed blank 96 lies in this connection above the $AC_1$ temperature, preferably above $AC_3$. The blank is introduced into a tool 102, consisting of an upper tool 104 and a lower tool 106, and is there heat formed and press hardened into a component 108. In the press hardening procedure the component 108 in the embossed regions 98 does not lie in direct contact with the upper tool 104. The cooling rate in these regions 98 is thus less than in the embossed regions 100. Consequently there is no structural change of the component 108 in these regions 98, so that the component 108 is hardened only in the non-embossed regions 100.

This production method can advantageously be combined with the partial hardening of the embossed blank during the hot embossing. By means of partial hardening of the blank in the embossed region due to the contact with the roller or with the embossing punch during the heat embossing and the hardening of the non-embossed regions in the press hardening tool 102, the embossed and non-embossed regions can be differently hardened either in the same way or by different cooling rates, so that it is possible for the thereby produced component to exhibit a large number of locally different hardness properties.

Figure 7:
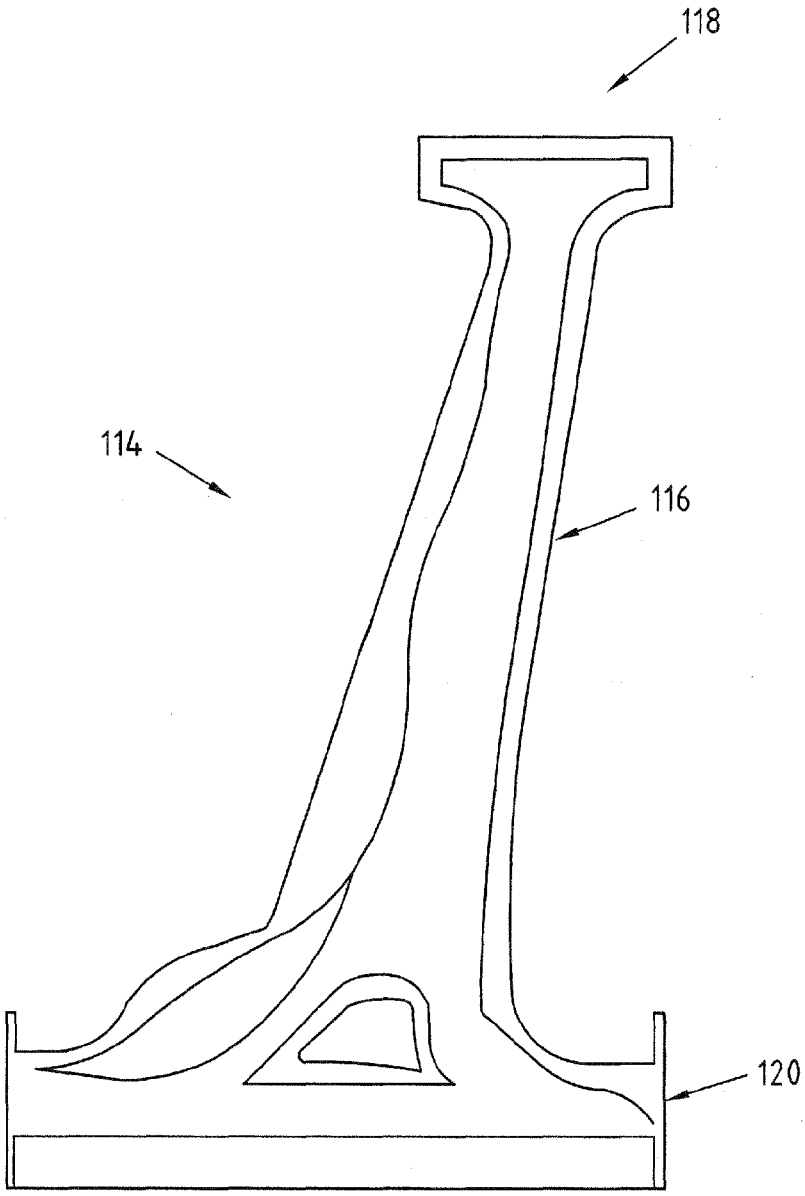
FIG. 7 shows an exemplary embodiment of the use according to the invention.

Finally FIG. 7 shows an exemplary embodiment for an advantageous use of a hot-embossed metal component as a B column 114. The B column 114 has a column region 116 as well as an upper connecting region 118 and a lower connecting region 120. In the production of car body elements such as for example B columns, there is the need to provide simultaneously a high strength of the component combined with a low weight. Due to the embossings produced by the method, on the one hand weight savings can be made since in the region of the embossings the material thickness is less, and on the other hand the strength or hardness can be specifically matched to the stress, in particular with regard to the crash behaviour of the corresponding component, since due to the structural changes during the embossing or the subsequent process steps the properties of the component can locally be specifically adjusted, for example in the connecting region 120.

The invention claimed is:

1. A method for producing a metal component, comprising a process for producing a metal component in which a starting material consisting of steel is provided, the starting material is embossed using an embossing tool and after the embossing, the embossed starting material is processed further to form a metal component, wherein the component has at least partially embossed regions, wherein the starting material is heated up to a temperature of above $AC_1$-temperature and is subsequently hot embossed, wherein the $AC_1$-temperature is a temperature at which austenite begins to form on heating of the starting material.

2. The method according to claim 1, wherein the starting material is hot embossed with a roller.

3. The method according to claim 1, wherein the starting material is hot embossed above an $AC_3$ temperature, wherein the $AC_3$ temperature is a temperature at which transformation of ferrite into austenite is completed on heating of the starting material.

4. The method according to claim 1, wherein the starting material is at least partially fully hardened in the embossed region.

5. The method according to claim 1, wherein the embossing tool is actively cooled during rolling.

6. The method according to claim 1, wherein the starting material consists of a manganese-boron steel.

7. The method according to claim 1, wherein the starting material is coated metallically or organically or inorganically.

8. The method according to claim 1, wherein the starting material after the embossing is tempered to the processing temperature for the subsequent further processing.

9. The method according to claim 1, wherein the starting material after the embossing is hot formed and/or press hardened.

10. The method according to claim 1, wherein the starting material is embossed with a microstructure.

11. The method according to claim 1, wherein as the starting material a first blank is used and the first blank after the embossing is joined over its surface area to a second blank preferably on the embossed side.

12. The method according to claim 10, wherein the first blank and the second blank are joined to one another by a cladding rolling and/or by combined hot forming.

13. The method according to claim 11, wherein the first blank consists of a different material than the second material.

14. The method according to claim 1, wherein the starting material is embossed specifically in the regions that contribute to the weight reduction.

15. The method according to claim 1, wherein the starting material is specifically embossed to take account of stress, in particular with regard to the crash behaviour.

16. The method according to claim 1, wherein fabricating a hot-embossed metal component for a vehicle body, more particularly as a reinforcing element in a B column, a rocker panel or a longitudinal member.

* * * * *